US006459355B1

(12) United States Patent
Furuhata et al.

(10) Patent No.: US 6,459,355 B1
(45) Date of Patent: Oct. 1, 2002

(54) THERMAL OVERLOAD RELAY

(75) Inventors: Yukinari Furuhata; Toshikatsu Ohgami; Fumihiro Morishita; Naoki Fukaya; Teruhisa Okutsu, all of Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 130 days.

(21) Appl. No.: 09/721,899

(22) Filed: Nov. 27, 2000

(30) Foreign Application Priority Data

Dec. 1, 1999 (JP) ..... 11-341776

(51) Int. Cl.[7] ..... H01H 71/74; H01H 71/76; H01H 75/08

(52) U.S. Cl. ..... 337/52; 337/52; 337/36; 337/16; 337/57; 335/45; 335/35; 335/176; 335/145

(58) Field of Search ..... 337/16, 1–3, 12–13, 337/35–38, 52, 54, 333; 335/8–10, 21–25, 35–45, 172–176, 195, 141, 145; 361/42, 46–50, 93, 99, 102–105, 170

(56) References Cited

U.S. PATENT DOCUMENTS 4,536,726 A * 8/1985 Hideo ..... 335/23
4,625,190 A * 11/1986 Wafer et al. ..... 335/20
4,636,760 A * 1/1987 Lee ..... 335/14
4,808,961 A * 2/1989 Sako et al. ..... 337/45
4,845,455 A * 7/1989 Sako et al. ..... 337/36
4,912,598 A * 3/1990 Grass ..... 361/652
5,107,714 A * 4/1992 Lamaignere ..... 74/100.2
5,767,762 A * 6/1998 Sako ..... 337/333

FOREIGN PATENT DOCUMENTS

EP 809270 A2 * 11/1997 ..... H01H/71/16
JP 8-279328 A * 10/1996 ..... H01H/61/00
JP 11-306947 A * 11/1999 ..... H01H/61/00
JP 2000-260289 A * 9/2000 ..... H01H/61/01

* cited by examiner

*Primary Examiner*—Anatoly Vortman
(74) *Attorney, Agent, or Firm*—Kanesaka & Takeuchi

(57) ABSTRACT

A thermal overload relay includes an inversion operation mechanism that is driven by a releasing lever to open or close a contact. The inversion operation mechanism includes a movable plate supported at one end so as to be inverted, and a tension spring for driving the movable plate for inversion. The releasing lever presses a middle of a wire of the tension spring to drive the movable plate for inversion. A projection is formed in the middle of the wire of the tension spring to contact with the releasing lever. Thus, a stable inversion operation can be made regardless of the positioning of an adjustment dial.

5 Claims, 5 Drawing Sheets

THERMAL OVERLOAD RELAY

BACKGROUND OF THE INVENTION AND RELATED ART STATEMENT

The present invention relates to a thermal overload relay for use in combination with an electromagnetic contactor, and in particular, to an inversion structure for stabilizing an inversion operation performed by the thermal overload relay.

To protect an electric motor from an overload, there is employed, as a standard distribution method, a method of combining a thermal overload relay with an electromagnetic contactor connected to a power circuit for the electric motor and allowing the electromagnetic contactor to cut of f current in an overload operation to stop the electric motor.

FIGS. 4 and 5 show a conventional thermal overload relay. FIG. 4 is a view of an internal mechanism of the thermal overload relay showing a steady or general state, and FIG. 5 is a view of the internal mechanism of the thermal overload relay showing an overload state.

In these figures, 1 is a main body case, 2 is a main bimetal (only one phase of a three-phase circuit is shown), 3 is a shifter coupled to a tip of the main bimetal 2, 4 is an inversion operation mechanism for opening or closing a contact, 5 is a normally closed contact comprising a movable contact 5*a* and a fixed contact 5*b*, 6 is a normally open contact comprising a fixed contact 6*a* and a movable contact 6*b*, 7 is a releasing lever journaled for rotational movement around a support point 7*b* to link the shifter 3 of the main bimetal 2 and the inversion operation mechanism 4 together, 8 is an adjustment link having a lower end supported in a slot 1*a* formed in the main body case 1, the adjustment link being coupled to a proximal end of the releasing lever 7 at the support point 7*b*, and 9 is an adjustment dial having a cam surface 9*a* on which an upper end 8*a* of the adjustment link 8 contacts.

Further, the inversion operation mechanism 4 comprises a pivotally movable plate 10 having one end locked and supported in a V-shaped groove 11*a* of a generally U-shaped support piece 11, a tension spring 12 (inversion driving spring) extending between a tip portion 1*a* of the movable plate 10 and a spring catching section 11*b* of the support piece 11, and a normally-open-contact driving lever 13 projecting backward from the movable plate 10 in the form of the character L. The movable plate 10 has the movable contact 5*a* of the normally closed contact 5 attached to a tip portion thereof. Additionally, the fixed contact 5*b* of the normally closed contact 5 is attached to a contact supporting piece 14 with a flat spring structure, having one end fixed to a bottom portion of the main body case 1 so as to lie horizontally with respect to the relay.

The tension spring 12 has a coil-like spring section 12*b* formed of a wire of a spring steel material and has hook sections formed at opposite ends thereof. The releasing lever 7 has a lever tip portion 7*a* in a circular form abutting against the middle of the wire of the tension spring 12.

With such a configuration, in a steady or normal state as shown in FIG. 4, the movable plate 10 of the inversion operation mechanism 4 is tilted clockwise from its neutral position under a force from the tension spring 12, and the movable contact 5*a* of the normally closed contact 5 connected in series with an electromagnetic coil of an electromagnetic contactor is pressed against the fixed contact 5*b* to maintain the contacts in the "on" state. In this state, the normally closed contact 6 is off.

Then, when overcurrent flows through a main circuit, the main bimetal 2 is heated and bent, and thus has its free end displaced to move the shifter 3 rightward. The releasing lever thus pivots around the support point 7*b* from a position shown by the dotted line to a position shown by the solid line as shown in FIG. 5. At this point, the middle of the wire of the tension spring 12 of the inversion operation mechanism 4 is pushed upward by the lever tip portion 7*a*. When the displacement of the tension spring exceeds a dead point of the movable plate 10, the movable plate 10 is rapidly driven to be inverted to separate the movable contact 5*a* of the normally closed contact 5 from the fixed contact 5*b*, and the drive lever 13 presses a movable contact shoe piece with the movable contact 6*b* attached thereto to bring the movable contact 6*b* to contact with the fixed contact 6*a* to turn on the contact.

Next, a method for adjusting a setting current value of the overcurrent relay will be described with reference to FIG. 4. In this figure, when the adjustment dial 9 is rotated, the adjustment link 8 with the upper end 8*a*, which abuts against the cam surface 9*a*, is displaced around the slot 1A in the case from a position shown by the solid line to a position shown by the dotted line. In connection with this, the releasing lever 7 coupled to the adjustment link 8 can be displaced and moved from a position shown by the solid line to a position shown by the dotted line to change the gap between the releasing lever 7 and a tip of the shifter 3. Further, this operation for adjusting the setting current value causes the lever tip portion 7*a* of the releasing lever 7 to move in a direction A (rightward) in the figure, wherein a movement range of the lever tip portion 7*a* is denoted by C.

The thermal overload relay of the above-described conventional structure has problems in operational characteristics as described below.

When the setting current value is adjusted by rotating the adjustment dial 9 as described above, the position of the lever tip portion 7*a* of the releasing lever 7 abutting against the wire of the tension spring 12 moves in the direction A along the middle of the wire of the tension spring 12 in the movement range C. When the lever tip portion 7*a* shifts in a lateral direction along the spring wire, the apparent lateral rigidity of the tension spring 12 changes, thereby changing an inversion operation characteristic of the movable plate 10. That is, when the position of the lever tip portion 7*a* moves in the direction A relative to the wire, the distance between the lever tip portion and the upper end 1*a* of the tension spring 12 decreases to increase the apparent lateral rigidity of the spring, to thereby reduce the flexion of the tension spring 12*b* when it is pushed by the shifter 3 via the releasing lever 7, the shifter 3 following the bending of the main bimetal 2. Consequently, the movable plate 10 of the inversion operation mechanism 4 can not be rapidly inverted but is slowly displaced upward.

It is an object of the present invention to solve the above problems and to provide an improved thermal overcurrent relay that achieves a stable inversion operation and stable characteristics thereof regardless of an adjustment of the setting current value.

SUMMARY OF THE INVENTION

To attain the above object, the present invention provides a thermal overload relay including an inversion operation mechanism that is driven by a releasing lever to open or close a contact. The inversion operation mechanism comprises a movable plate supported so as to be inverted by using one end thereof as a support point, and a tension spring for driving the movable plate for inversion. The releasing lever presses the middle of a wire of the tension spring to drive the movable plate for inversion. In the invention, a projection is formed in the middle of the wire of the tension spring to abut against the releasing lever.

According to the invention, even when the adjustment dial is used to displace the releasing lever via the adjustment link, since the position of the projection formed in the middle of the wire of the tension spring remains unchanged, a stable inversion operation is obtained.

Further, in the above-described thermal overload relay, if the projection formed on the tension spring deviates from an axis joining opposite ends of the tension spring together, the deflection of the tension spring is suppressed to enable a more stable inversion operation.

DETAILED DESCRIPTION OF A PREFERRED EMBODIMENT

Figure 1:
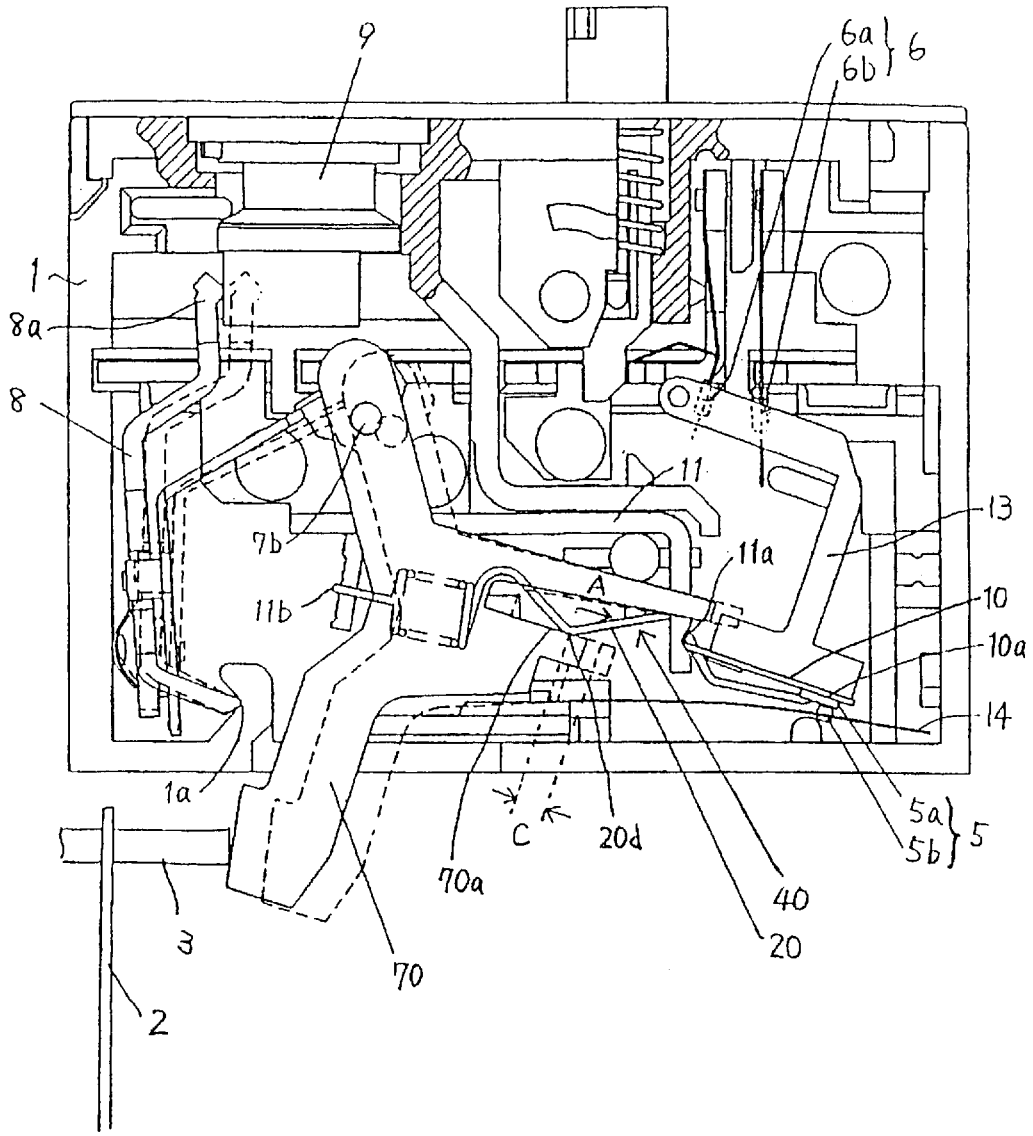
FIG. 1 is a view of an internal mechanism of a thermal overload relay in a steady or normal state according to an embodiment of the present invention.

An embodiment of the present invention will be described with reference to the drawings. The members in FIGS. 1 to 3 that are the same as in the conventional example are denoted by the same reference numerals and description thereof is thus omitted.

Figure 2:
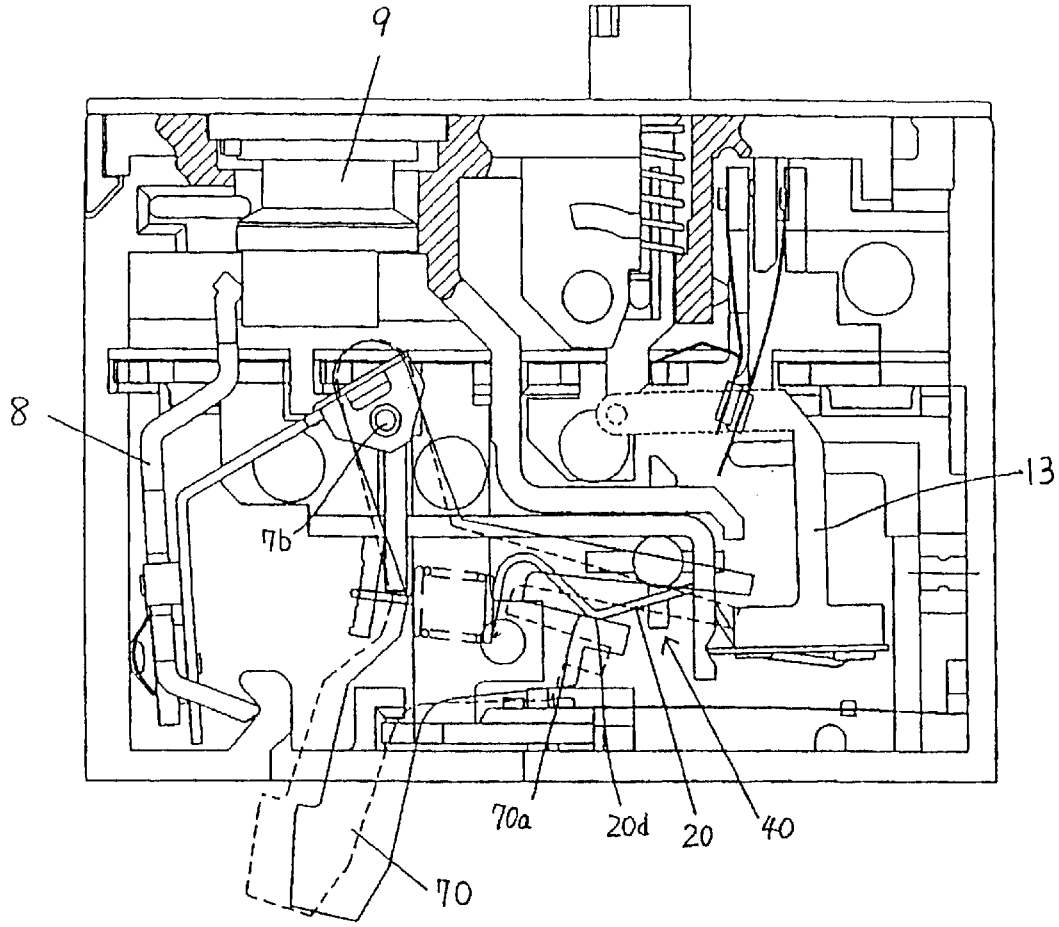
FIG. 2 is a view of the internal mechanism of the thermal overload relay in an overload state according to the embodiment of the present invention.
Figure 3:
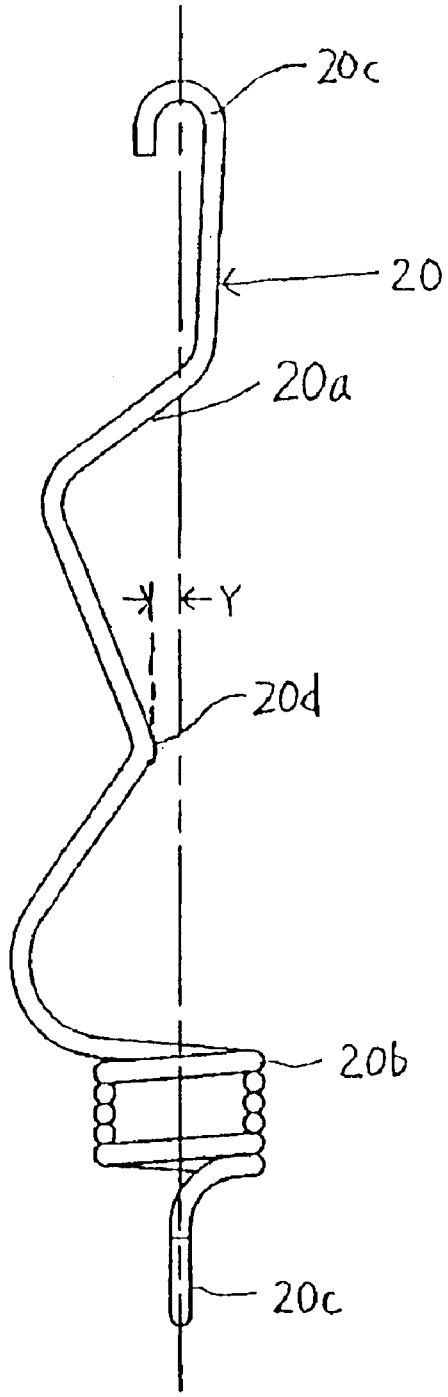
FIG. 3 is a perspective view of a tension spring shown in FIG. 1.

FIG. 1 is a view of an internal mechanism of a thermal overload relay showing a steady or normal state, and FIG. 2 is a view of the internal mechanism of the same relay showing an overload state. FIG. 3 is a perspective view of a tension spring, shown in FIG. 1.

Figure 4:
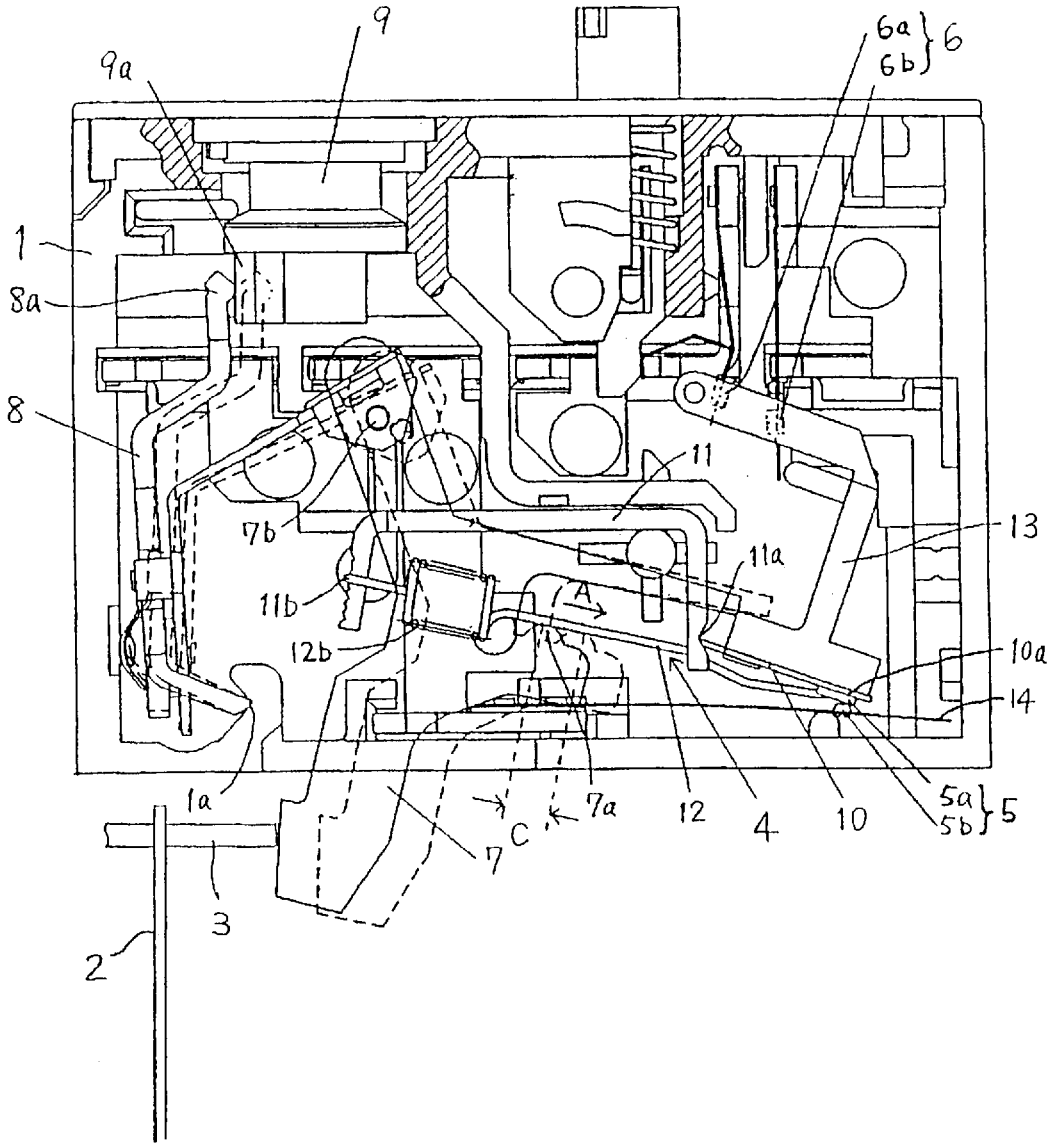
Fig. 4 Prior Art
FIG. 4 is a view of an internal mechanism of a conventional thermal overload relay in a steady or normal state.
Figure 5:
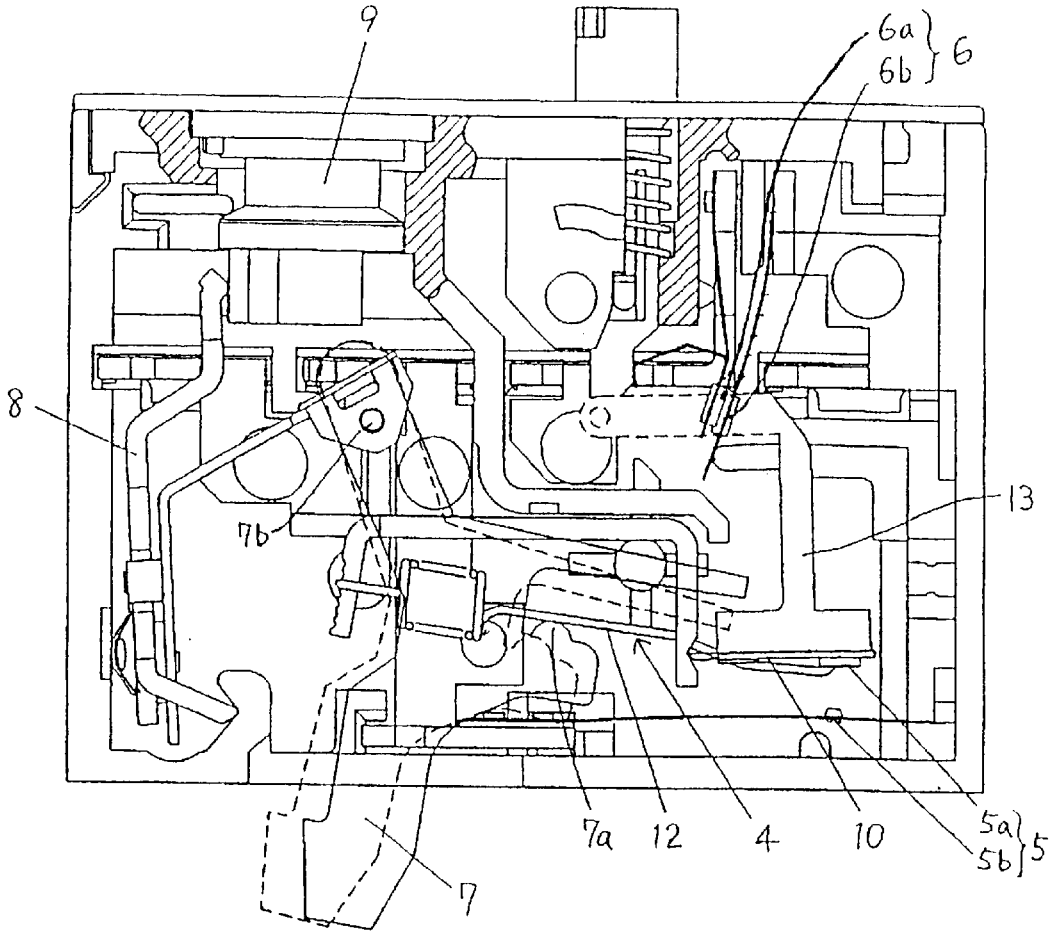
Fig. 5 Prior Art
FIG. 5 is a view of the internal mechanism of the conventional thermal overload relay in an overload state.

The thermal overload relay according to the embodiment shown in the figures is essentially similar to the thermal overload relay shown in FIG. 4, but differs therefrom in that a tension spring 20 extending between a movable plate 10 of an inversion operation mechanism 40 and a spring catching section 11*b* of a support piece 11 is shaped as shown in FIG. 3, and in that a top portion of a releasing lever 70 that presses the middle of a wire of the tension spring 20 is formed to have a flat surface 70*a*.

In FIG. 3, the tension spring 20 is formed of a wire of a spring steel material 20*a*, and includes a coil-like spring section 20*b* and hook sections 20*c* formed at vertically opposite ends thereof. A projection 20*d* is formed between the hook section 20*c* at the upper end and the coil section 20*b* to abut against the flat surface 70*a* of the releasing lever 70. Additionally, the projection 20*d* is set to deviate from an axis joining the hook sections 20*c*, 20*c* at the opposite ends, by an amount of deviation Y.

At the same time, the tip portion of the releasing lever 70 abutting against the projection 20*d* of the tension spring 20 is formed to have the flat surface 70*a* over a lateral movement range C where the tip portion moves when an adjustment dial 9 is operated. In the steady state shown in FIG. 1, the projection 20*d* formed in the middle of the tension spring 20 is pressed by the flat surface 70*a* formed at the tip portion of the releasing lever 70.

With such a configuration, even when the adjustment dial 9 is operated to displace and move the flat surface 70*a* of the releasing lever 70 in the direction A as shown in FIG. 1, the position of the tension spring 20 pressed by the projection 70*a* of the releasing lever 70 is not displaced in the lateral direction. Further, as a main bimetal 2 bends, the releasing lever 70 pushes the tension spring 20 from the same position to invert the movable plate 10. This enables a stable inversion operation without delay.

Since the bent portion is only partly formed in the tension spring 20, it requires no separate part, thereby enabling the inexpensive supply of parts. Additionally, since the projection 20*d* formed in the middle of the tension spring 20 deviates from the axis joining the opposite ends of the tension spring together by the amount of deviation Y, the deflection of the tension spring can be suppressed to enable a more stable inversion operation.

As described above, according to the present invention, a stable inversion operation and stable characteristics thereof are obtained regardless of the adjustment of the setting current value, and the tension spring is only partly formed with the bent portion. Therefore, no separate part is required, thereby enabling the inexpensive supply of parts.

While the invention is explained with reference to the specific embodiment of the invention, the explanation is illustrative and the invention is limited only by the appended claims.

What is claimed is:

1. A thermal overload relay for an output contact comprising:

a main bimetal to be bent by overcurrent for opening and closing a contact, a releasing lever situated near the main bimetal to be displaced by an operation of the main bimetal, an inversion operation mechanism driven by the releasing lever to open or close the contact, said inversion operation mechanism including a movable plate having a support point to be inverted at the support point, and a tension spring for inverting the movable plate supported and pressed by a middle of the releasing lever to be actuated by the releasing lever for inversion, said tension spring having a projection in a middle of thereof and contacting the releasing lever, an adjustment link coupled to one end of the releasing lever to move the releasing lever, and an adjustment dial for adjusting a setting current coupled to the adjustment link to move the releasing lever through the adjustment link.

2. A thermal overload relay according to claim 1, wherein said projection formed at the tension spring is deviated from an axis joining opposite ends of the tension spring.

3. A thermal overload relay according to claim 2, wherein said releasing lever includes a flat portion contacting the projection of the tension spring so that when the adjustment dial is actuated, the projection always contacts the flat portion.

4. A thermal overload relay according to claim 3, wherein said main bimetal includes a shifter contacting the releasing lever.

5. A thermal overload relay according to claim 4, wherein said tension spring is formed of a wire, and includes a coil portion at one side, and two hooks at two ends thereof, said projection being formed between the coil portion and one of the hooks away from the coil portion.

* * * * *

UNITED STATES PATENT AND TRADEMARK OFFICE

CERTIFICATE OF CORRECTION

PATENT NO. : 6,459,355 B1
DATED : October 1, 2002
INVENTOR(S) : Yukinari Furuhata et al.

It is certified that error appears in the above-identified patent and that said Letters Patent is hereby corrected as shown below:

Column 1,
Line 13, change “of f” to -- off --;
Line 41, change “1a” to -- 10a --; and Column 2,
Line 44, change “1a” to -- 10a --.

Signed and Sealed this

Eighteenth Day of February, 2003

JAMES E. ROGAN
*Director of the United States Patent and Trademark Office*